US010882096B2

(12) United States Patent
Holmstock

(10) Patent No.: US 10,882,096 B2
(45) Date of Patent: Jan. 5, 2021

(54) METHODS AND APPARATUSES FOR MECHANICALLY OPENING AND CLOSING ONE OR MORE LONGITUDINAL SEAMS

(71) Applicant: Brian Patrick Holmstock, Columbia, MD (US)

(72) Inventor: Brian Patrick Holmstock, Columbia, MD (US)

( * ) Notice: Subject to any disclaimer, the term of this patent is extended or adjusted under 35 U.S.C. 154(b) by 419 days.

(21) Appl. No.: 15/820,569

(22) Filed: Nov. 22, 2017

(65) Prior Publication Data

US 2018/0141103 A1 May 24, 2018

Related U.S. Application Data

(60) Provisional application No. 62/497,540, filed on Nov. 22, 2016, provisional application No. 62/497,541, filed on Nov. 22, 2016, provisional application No. 62/497,542, filed on Nov. 22, 2016, provisional application No. 62/497,543, filed on Nov. 22, 2016.

(51) Int. Cl.
*B21D 39/02* (2006.01)

(52) U.S. Cl.
CPC ..... *B21D 39/025* (2013.01)

(58) Field of Classification Search
CPC .... B21D 39/025; B21D 39/021; B21D 39/03; B21D 5/16
USPC ..... 72/458
See application file for complete search history.

(56) References Cited

U.S. PATENT DOCUMENTS 1,324,693 A * 12/1919 Rush ..... B21D 7/063 72/458
1,326,907 A * 1/1920 Bond ..... B21D 1/08 72/458
1,344,533 A * 6/1920 Cole ..... B21D 1/08 72/458
2,938,413 A * 5/1960 Pauls ..... B21D 53/02 72/479
3,965,720 A * 6/1976 Goodwin ..... B21D 11/10 72/458
4,034,595 A * 7/1977 Smith ..... B21D 39/025 72/458
4,619,132 A * 10/1986 McBee ..... B21D 1/10 72/458
5,389,099 A * 2/1995 Hartmeister ..... A61B 17/8863 606/101
5,937,695 A * 8/1999 Patterson ..... B21D 19/08 72/458

(Continued)

*Primary Examiner* — Adam J Eiseman
*Assistant Examiner* — Bobby Yeonjin Kim
(74) *Attorney, Agent, or Firm* — Muir Patent Law, PLLC

(57) ABSTRACT

The disclosed embodiments includes apparatuses, devices, and methods for inserting a male component of a first sheet metal portion into a female component of a second sheet metal portion, placing the longitudinal straight seam closing tool over the male and female components, and applying pressure to the longitudinal straight seam closing tool. The longitudinal straight seam closing tool includes an interior block portion, an exterior block portion, and a closing channel formed between the interior block portion and the exterior block portion, the interior block portion being configured to contact the first sheet metal portion and the closing channel being configured to extend over a protrusional tab of the female component when the interior block portion is in contact with the first sheet metal portion.

16 Claims, 16 Drawing Sheets

(56) References Cited

U.S. PATENT DOCUMENTS

| | | | | |
|---|---|---|---|---|
| 6,077,271 | A * | 6/2000 | Huebner | A61B 17/8863 606/101 |
| 8,424,361 | B1 * | 4/2013 | Evans | B25B 27/02 72/458 |
| 2018/0141103 | A1 * | 5/2018 | Holmstock | B21D 39/025 |

* cited by examiner

METHODS AND APPARATUSES FOR MECHANICALLY OPENING AND CLOSING ONE OR MORE LONGITUDINAL SEAMS

CROSS-REFERENCE TO RELATED APPLICATION

This application claims the benefit of priority under 35 U.S.C. § 119 to U.S. Provisional Application No. 62/497,540, filed Nov. 22, 2016, U.S. Provisional Application No. 62/497,541, filed Nov. 22, 2016, U.S. Provisional Application No. 62/497,542, filed Nov. 22, 2016, and U.S. Provisional Application No. 62/497,543, filed Nov. 22, 2016, in the United States Patent and Trademark Office, the entire contents of all of which are hereby incorporated by reference.

FIELD

This present disclosure relates to apparatuses for opening and closing one or more longitudinal seams. In particular, the present disclosure relates to apparatuses for mechanically opening and closing one or more longitudinal seams pertaining to Pittsburgh locks associated with sheet metal duct sections used to form duct assemblies commonly associated with forced air heating, ventilation, and air conditioning (HVAC) systems.

BACKGROUND

Sheet metal duct assemblies are used extensively in both commercial and residential applications to transport and distribute heated or cooled air to buildings, personal residences, and other structures. These duct assemblies are commonly formed from different gauges of sheet metal in sections of predetermined length which are then secured together, either at a fabrication shop or at a construction site, to form longer spans as needed and thereby form a continuous duct for distributing air.

Such duct assemblies most often have a rectilinear trunk lines and fittings having four sides which are joined together through the use of one or more commonly employed Pittsburgh seams. For example, with the Pittsburgh seam, one edge of each piece of a duct assembly is formed with a longitudinally extending groove to form the female portion of the joint, while the other edge is bent over along its length to provide the male portion of the joint. The two parts are then assembled by inserting the male portion of each part into the female portion leaving an edge extending beyond the joint from the female portion. The edge is bent over to lock the seam.

This seam can be difficult and inconvenient to assemble, and this time-consuming process can diminish productivity and increase costs. Conventional tools are not sufficient for opening and assembling the lock.

The disclosed embodiments provide for simple, time-saving and cost-effective, convenient, devices and methods to open and close Pittsburgh seams in sheet metal ductwork assemblies.

SUMMARY

In some exemplary embodiments, the present disclosure is directed to a handheld tool for opening and closing seams of duct assemblies, comprising: an opening portion including a latching portion and an opening channel recessed into the latching portion, the opening channel being configured to receive and retain a protrusional tab of a first sheet metal portion having a female component of a longitudinal straight seam; and a closing portion including an interior block portion, an exterior block portion, and a closing channel formed between the interior block portion and the exterior block portion, the interior block portion being configured to contact a second sheet metal portion having a male component of the longitudinal straight seam and the closing channel being configured to extend over the protrusional tab when the interior block portion is in contact with the second sheet metal portion.

In some aspects, the opening portion has a top surface having a length of about 2 inches, and a bottom surface having a length of about 1.5 inches, and the top surface and the bottom surface are substantially parallel to one another.

In some aspects, the opening portion has an end surface having a length of about 0.75 inches, and the end surface is substantially perpendicular to the top surface and the bottom surface.

In some aspects, the closing portion has a length of about 5 inches, a height of about 1.25 inches, and a width of about 0.625 inches.

In some aspects, the interior block portion has a length of about 5 inches, a height of about 0.874 inches, and a width of about 0.250 inches.

In some aspects, the exterior block portion has a length of about 5 inches, a height of about 1.25 inches, and a width of about 0.187 inches.

In some aspects, the closing channel has an interior height of about 0.437 inches, and an interior width of about 0.187 inches.

In some aspects, the closing channel extends continuously along the closing portion.

In some exemplary embodiments, the present disclosure is directed to a handheld tool for closing seams of duct assemblies, comprising: a closing portion including an interior block portion, an exterior block portion, and a closing channel formed between the interior block portion and the exterior block portion, the interior block portion being configured to contact a first sheet metal portion having a male component of a longitudinal straight seam and the closing channel being configured to extend over a protrusional tab of a first sheet metal portion having a female component of the longitudinal straight seam when the interior block portion is in contact with the first sheet metal portion; and a handle portion having a tubular shape and including a crown portion, a transition portion, a grip portion between the crown portion and the transition portion, and an end surface adjacent to the crown portion and being perpendicular to a side surface of the handle portion.

In some aspects, the exterior block portion has a first side surface having a length of about 1.5 inches, and a second side surface having a length of about 1.125 inches, the first side surface of the exterior block portion is substantially parallel to the second side surface of the exterior block portion, and the second side surface of the exterior block portion faces the closing channel.

In some aspects, the interior block portion has a first side surface having a length of about 1.0 inches, and a second side surface having a length of about 0.625 inches, the first side surface of the interior block portion is substantially parallel to the second side surface of the interior block portion, and the second side surface of the interior block portion faces the closing channel.

In some aspects, the closing channel has an interior width of about 1.125 inches and an interior height of 0.187 inches, and the interior height is measured from the second side surface of the exterior block portion to the second side surface of the interior block portion.

In some aspects, the handle portion has a diameter of about 0.75 inches, and a length of about 2.187 inches.

In some aspects, the closing channel is configured to receive the protrusional tab of the female component.

In some aspects, the closing portion and the handle portion are formed from a single piece of metal.

In some exemplary embodiments, the present disclosure is directed to a method for using a longitudinal seam closing tool, comprising: inserting a male component of a first sheet metal portion into a female component of a second sheet metal portion; placing the longitudinal seam closing tool over the male and female components, wherein the longitudinal seam closing tool includes an interior block portion, an exterior block portion, and a closing channel formed between the interior block portion and the exterior block portion, the interior block portion being configured to contact the first sheet metal portion and the closing channel being configured to extend over a protrusional tab of the female component when the interior block portion is in contact with the first sheet metal portion; and applying pressure to the longitudinal seam closing tool.

In some aspects, the interior block portion has a length of about 5 inches, a height of about 1.25 inches, and a width of about 0.250 inches, the exterior block portion has a length of about 5 inches, a height of about 0.874 inches, and a width of about 0.187 inches, and the closing channel has a length of about 5 inches, an interior height of about 0.437 inches, and an interior width of about 0.187 inches.

In some aspects, the longitudinal seam closing tool further comprises: an opening portion including a latching portion and an opening channel recessed into the latching portion, the opening channel being configured to receive and retain the protrusional tab of the female component, wherein the opening portion has a top surface having a length of about 2 inches, and a bottom surface having a length of about 1.5 inches, the top surface and the bottom surface being substantially parallel to one another, and wherein the opening portion has an end surface having a length of about 0.75 inches, the end surface being substantially perpendicular to the top surface and the bottom surface.

In some aspects, the exterior block portion has a first side surface having a length of about 1.5 inches, and a second side surface having a length of about 1.125 inches, the first side surface of the exterior block portion being substantially parallel to the second side surface of the exterior block portion, the second side surface of the exterior block portion facing the closing channel, the interior block portion has a first side surface having a length of about 1.0 inches, and a second side surface having a length of about 0.625 inches, the first side surface of the interior block portion being substantially parallel to the second side surface of the interior block portion, and the second side surface of the interior block portion facing the closing channel, and the closing channel has an interior width of about 1.125 inches and an interior height of 0.187 inches, the interior height being measured from the second side surface of the exterior block portion to the second side surface of the interior block portion.

In some aspects, the longitudinal seam closing tool further comprises: a handle portion having a tubular shape and including a crown portion, a transition portion, a grip portion between the crown portion and the transition portion, and an end surface adjacent to the crown portion and being perpendicular to a side surface of the handle portion, wherein the handle portion has a diameter of about 0.75 inches and a length of about 2.187 inches.

BRIEF DESCRIPTION OF THE DRAWINGS

The above and other objects and features will become apparent from the following description with reference to the following figures, wherein like reference numerals refer to like parts throughout the various figures unless otherwise specified. The drawings are not necessarily to scale, emphasis instead being placed upon illustrating the principles of the disclosed embodiments. In the drawings.

DETAILED DESCRIPTION

Figure 1:
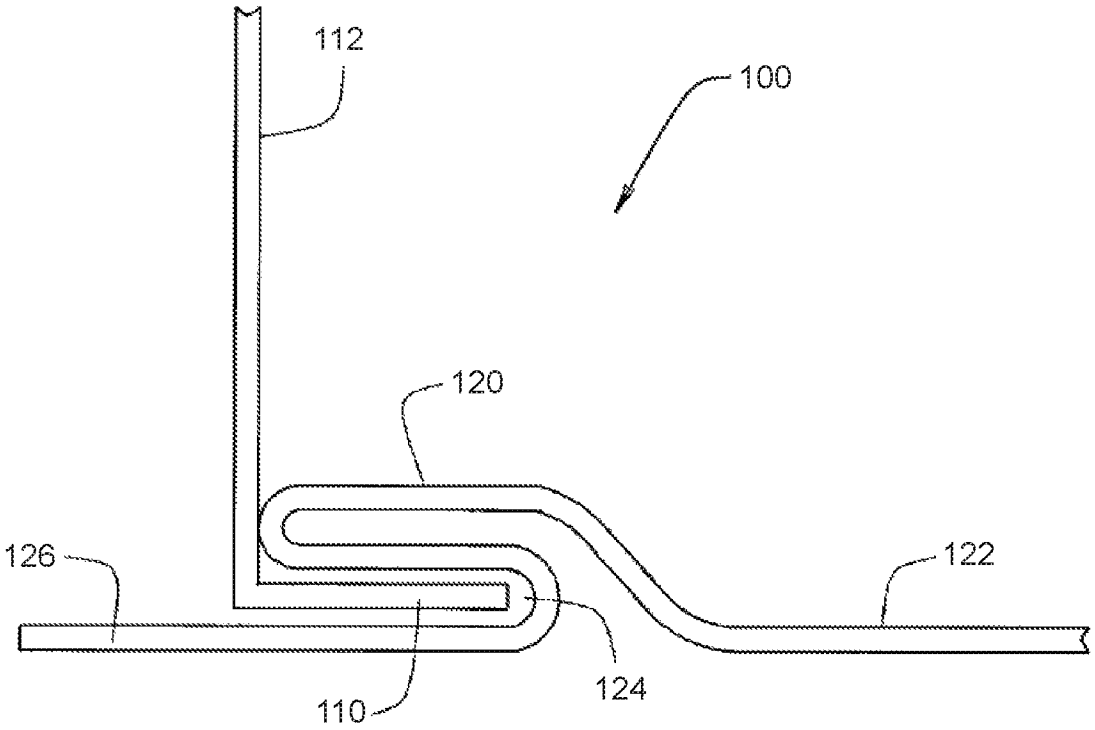
FIG. 1 is a partial side elevation view illustrating a standard Pittsburgh seam prior to closing.

Various exemplary embodiments will be described in detail with reference to the accompanying drawings. The inventive concept, however, may be embodied in various different forms, and should not be construed as being limited only to the illustrated embodiments. Accordingly, known processes, elements, and techniques are not described with respect to some of the embodiments of the disclosure. Unless otherwise noted, like reference numerals denote like elements throughout the attached drawings and written description, and thus descriptions will not be repeated. In the drawings, the sizes and relative sizes of layers and regions may be exaggerated for clarity. Though the different figures show variations of exemplary embodiments, these figures are not necessarily intended to be mutually exclusive from each other. Rather, as will be seen from the context of the detailed description below, certain features depicted and described in different figures can be combined with other features from other figures to result in various embodiments, when taking the figures and their description as a whole.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising" or "includes" and/or "including," when used in this specification, specify the presence of stated features, regions, integers, steps, operations, elements, components, and/or groups, but do not preclude the presence or addition of one or more other features, regions, integers, steps, operations, elements, components, and/or groups thereof. In addition, unless the context indicates otherwise, steps described in a particular order need not occur in that order. As used herein, the term "and/or" includes any and all combinations of one or more of the associated listed items.

It will be understood that, although the terms "first," "second," "third," etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the disclosure.

As will be understood, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood, all language such as "up to," "at least," "greater than," "less than," and the like include the number recited and refer to ranges which can be subsequently broken down into subranges as discussed above. Finally, as will be understood, a range includes each individual member. Thus, for example, a group having 1-3 members refers to groups having 1, 2, or 3 members. Similarly, a group having 1-5 members refers to groups having 1, 2, 3, 4, or 5 members, and so forth.

Terms such as "same," "equal," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to emphasize this meaning, unless the context or other statements indicate otherwise. For example, items described as "substantially the same," "substantially equal," or "substantially planar," may be exactly the same, equal, or planar, or may be the same, equal, or planar within acceptable variations that may occur, for example, due to manufacturing processes. The term "about," as used herein when referring to orientation, layout, location, shapes, sizes, amounts, or other measures do not necessarily mean an exactly identical orientation, layout, location, shape, size, amount, or other measure, but is intended to encompass orientations, layouts, locations, shapes, sizes, amounts, or other measures within acceptable variations or ranges of such values.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a side view illustrating a standard Pittsburgh seam 100 formed by mating two sheet metal duct sections. Generally, each sheet metal duct section includes both a female component and a male component at opposite ends of a single sheet metal duct section. In FIG. 1, the male component 110 of a first sheet metal duct section is shown in a mated position with a female component 120 of a second sheet metal duct section. The Pittsburgh seam 100 illustrated in FIG. 1 is engaged, but not closed and locked. In FIG. 1, the sheet metal duct sections may be 28 gauge–16 gauge.

As shown in FIG. 1, the male component 110 of the Pittsburgh seam 100 corresponds to and extends along one longitudinal edge of a sheet metal portion 112 of a first duct section. The female component 120 of the Pittsburgh seam 100 corresponds to and extends along one longitudinal edge of a sheet metal portion 122 of a second duct section. The male component 110 is formed by bending the entire longitudinal edge of sheet metal portion 112 inwardly (towards an interior region of a duct section) at approximately 90° as illustrated in FIG. 1. The male component 110 may be, for example, ⅜" or ¼" in height.

The female component 120 of the Pittsburgh seam 100 includes a receiving channel or slot 124 for receiving the male component 110. The receiving channel 124 of the female component 120 is formed by bending the entire longitudinal edge of a second sheet metal portion 122 into an S-shaped bend as illustrated in FIG. 1. The receiving channel 124 of the female component 120 is formed as part of the S-shaped bend and includes a protrusional tab 126 which extends beyond the partially formed seam when the male component 110 is positioned within the receiving channel 124. The receiving channel 124 may have a depth of ⅜" or ¼" to accommodate the full height of the male component 110 when the male component 110 is positioned within the receiving channel 124. The protrusional tab 126 extends beyond the first sheet metal portion 112 and is designed to be bent inwardly (toward an interior region of a duct section) so that it lies adjacent to the first sheet metal portion 112 when the seam 100 is closed and locked. When the male component 110 is inserted into the female component 120, the protrusional tab 126 may extend beyond the sheet metal portion 112 by, for example, ⅜" or ¼".

In order to close and lock the Pittsburgh seam 100 and the corresponding abutting sheet metal portions and thereby form the duct assembly, the protrusional tab 126 is bent and hammered over, either manually or through mechanical means. When fully closed and locked, the protrusional tab 126 will lie against and abut the outer surface of the sheet metal portion 112.

Figure 2A:
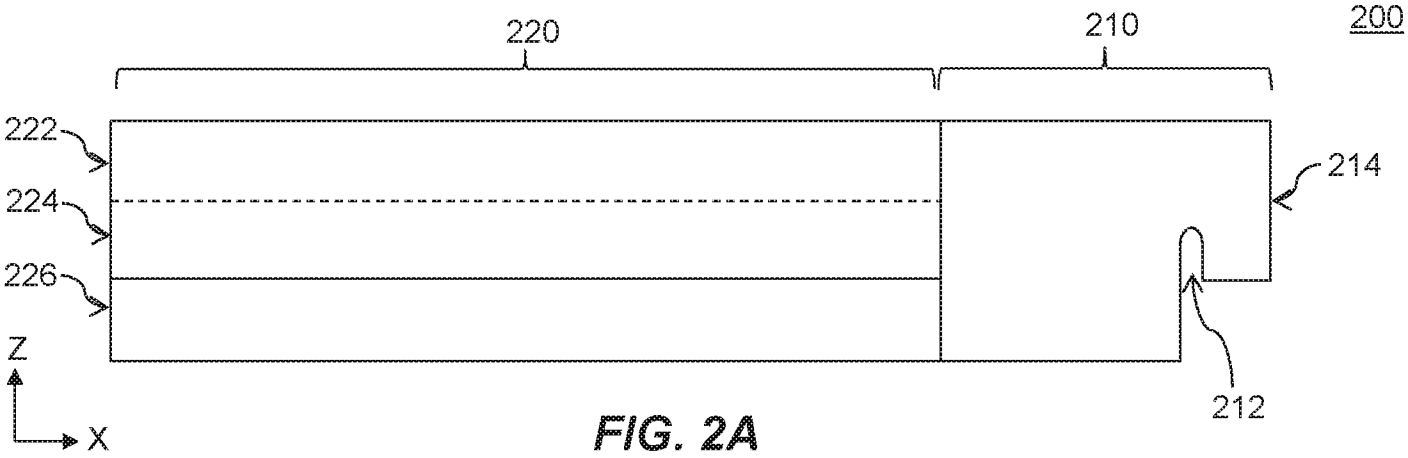
FIGS. 2A-2B are schematics illustrating a side view of a straight seam lock block, according to certain exemplary embodiments.
Figure 2B:
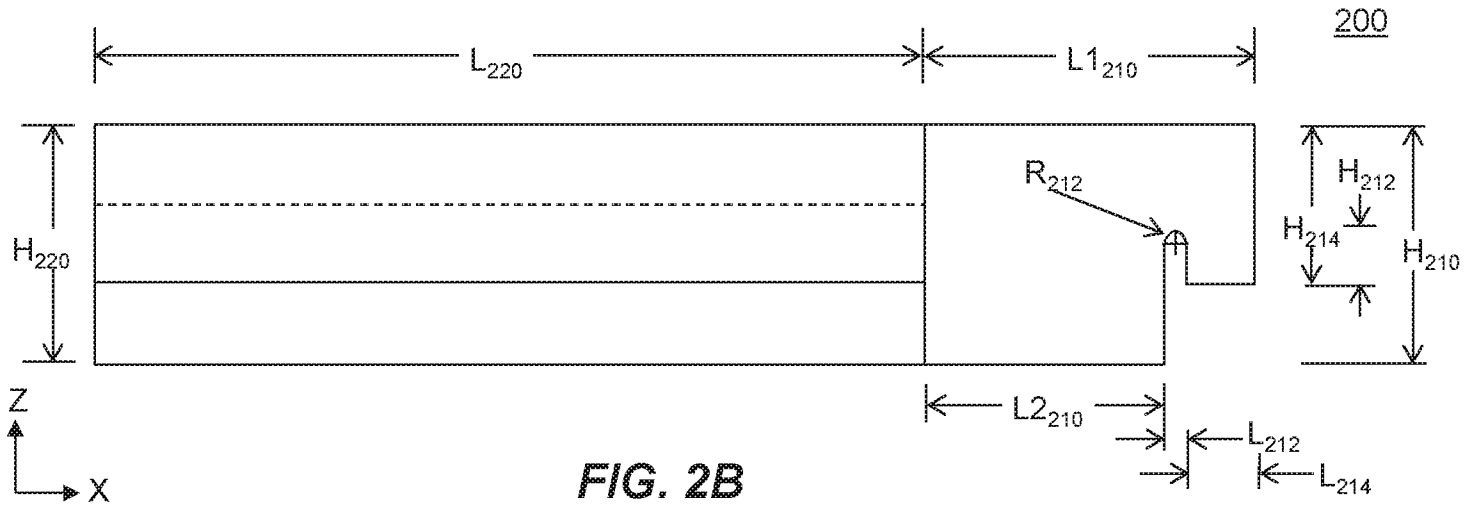
Figure 3A:
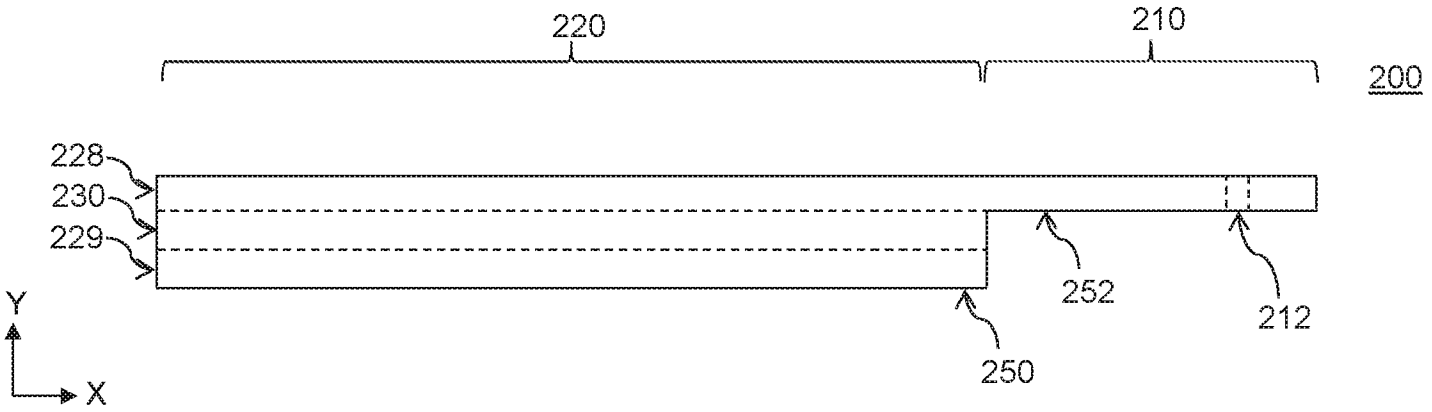
FIGS. 3A-3B are schematics illustrating a top view of a straight seam lock block, according to certain exemplary embodiments.
Figure 3B:
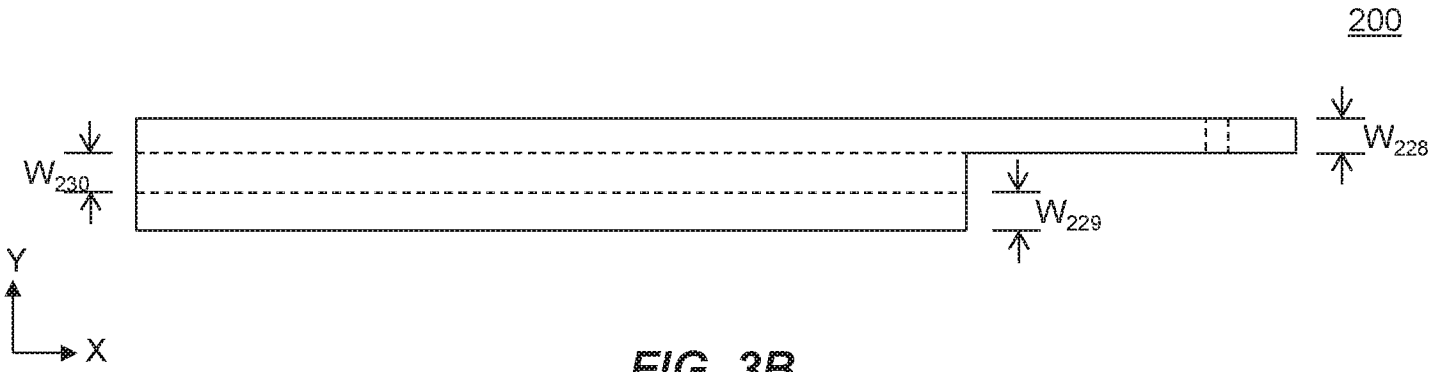
Figure 4B:
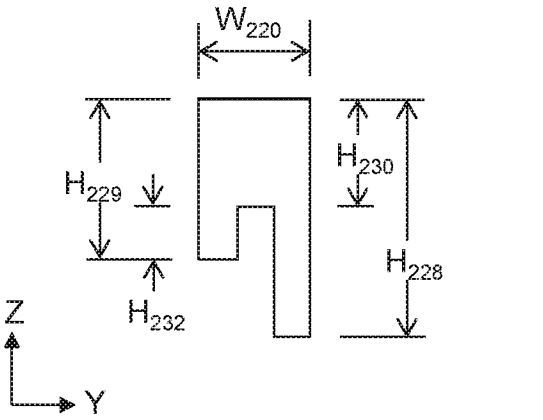
FIGS. 4A-4B are schematics illustrating an end view of the straight seam lock block, according to certain exemplary embodiments.
Figure 4A:
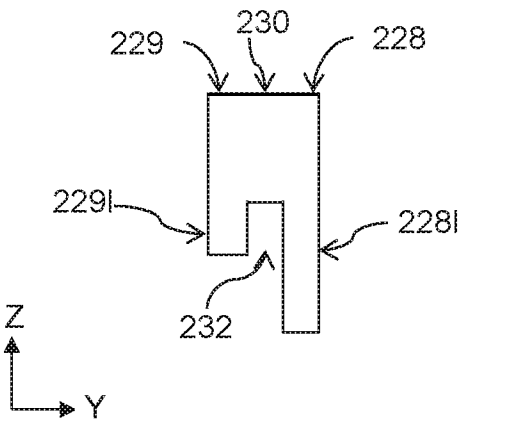

FIGS. 2A and 2B are schematics corresponding to a side view of an example straight seam lock block 200, FIGS. 3A and 3B are schematics corresponding to a top view of the example straight seam lock block 200, and FIGS. 4A and 4B are schematics corresponding to an end view of the example straight seam lock block 200. FIG. 5 is a perspective view of the straight seam lock block 200 of FIGS. 2A-2B, 3A-3B, and 4A-4B. The straight seam lock block 200 may be a handheld tool configured for mechanically opening and closing Pittsburgh seams. The straight seam lock block 200 may have a shape that is generally rectangular in shape and width, and may have milled flat or planar surfaces. The straight seam lock block 200 may be a single unitary tool formed of a metal, such as, for example, steel. The straight seam lock block 200 may be formed from a single, solid block of such a metal by, for example, milling or other metal-working processes.

As shown in FIGS. 2A and 2B, the straight seam lock block 200 may have an opening portion 210 and a closing portion 220. The opening portion 210 may be that portion of the straight seam lock block 200 configured to open a female component 120 of a duct section. The opening portion 210 may include a latching portion 214 and an opening channel 212. A top surface of the opening portion 210 may have a length $L1_{210}$ in the range of 1-3 inches, and more particularly a length $L1_{210}$ of about 2 inches, and a bottom surface of the opening portion 210 may have a length $L2_{210}$ in the range of 0.75-2.5 inches, and more particularly a length $L2_{210}$ of about 1.5 inches. The opening portion 210 may have an overall height $H_{210}$ in the range of 1-1.5 inches, and more particularly an overall height $H_{210}$ of about 1.25 inches. The top surface and the bottom surface of the opening portion 210 may be substantially parallel to one another, and an end surface of the opening portion 210 may be substantially perpendicular to the top and bottom surfaces of the opening portion 210.

The opening channel 212 may be a groove formed in the opening portion 210. The opening channel 212 may be configured to receive and engage with the protrusional tab 126 of the female component 120. The opening channel 212 may have an interior height $H_{212}$ in the range of 0.25-0.75 inches, and more particularly an interior height $H_{212}$ of about 0.375 inches. The opening channel 212 may have an interior length $L_{212}$ in the range of 0.1-0.2 inches, and more particularly an interior length $L_{212}$ of about 0.125 inches. In some embodiments, the opening channel 212 may have a rounded interior shape, having a radius $R_{212}$ in the range of 0.05-0.2 inches, and more particularly a radius $R_{212}$ of about 0.0625 inches. Although not illustrated, the opening channel 212 may have other shapes, such as, for example, a polygonal shape (i.e., triangular, square, pentagonal, etc.).

The latching portion 214 may be that portion of the opening portion that extends over and beyond the opening channel 212. The latching portion 214 may be configured to engage with the protrusional tab 126 and provide leverage when the protrusional tab 126 of a female component 120 is inserted in the opening channel 212. The latching portion 214 may have a surface height $H_{214}$ in the range of 0.5-1.25 inches, and more particularly a height $H_{214}$ of about 0.75 inches, and a length $L_{214}$ in the range of 0.25-0.75 inches, and more particularly a length $L_{214}$ of about 0.375 inches.

The closing portion 220 may be that portion of the straight seam lock block 200 that is configured to receive pressure and transfer the received pressure to the male component 110 of a Pittsburgh seam, thereby causing the male component 110 to firmly engage with the female component 120 into which it is inserted. The closing portion 220 may include a top section 222, a middle section 224, and a bottom section 226. The closing portion 220 may have a length $L_{220}$ in the range of 4-6 inches, and more particularly a length $L_{220}$ of about 5 inches, and a height $H_{220}$ in the range of 1-2 inches, and more particularly a height $H_{220}$ of about 1.25 inches. The top section 222 may have a height $H_{222}$ of about 0.437 inches, the middle section 224 may have a height $H_{224}$ of about 0.437 inches, and the bottom section 226 may have a height $H_{226}$ of about 0.375 inches.

Referring to FIGS. 3A and 3B, which are top-down views of the straight seam lock block 200, the closing portion 220 may further include an exterior block portion 228, an interior block portion 229, and a center block portion 230. The exterior block portion 228 may have a width $W_{228}$ in the range of 0.125-0.250 inches, and more particularly a width $W_{228}$ of about 0.187 inches. The interior block portion 229 may have a width $W_{229}$ in the range of 0.125-0.450 inches, and more particularly a width $W_{229}$ of about 0.250 inches. The center block portion 230 may have a width $W_{230}$ in the range of 0.125-0.250 inches, and more particularly a width $W_{230}$ of about 0.187 inches. The opening portion 210 may have a width that corresponds to the width of the exterior block portion 229. For example, the opening portion 210 may have a width $W_{210}$ in the range of 0.125-0.250 inches, and more particularly a width $W_{210}$ of about 0.187 inches.

Although the lengths of the interior block portion 229 and the center block portion 230 are illustrated as being the same length, and the ends of the interior block portion 229 and the center block portion 230 as being even with one another, other embodiments are anticipated. For example, the ends of each of the exterior block portion 228, the interior block portion 229, and the center block portion 230 may be curved such that the ends of each of exterior block portion 228, the interior block portion 229, and the center block portion 230 may gradually increase from a front surface 250 of the interior block portion 229 to a front surface 252 of the exterior block portion 228 (see, e.g., FIG. 6A with R.50).

Referring to FIGS. 4A and 4B, which are end views of the closing portion 220 of the straight seam lock block 200, the exterior block portion 228 may have a lower exterior block portion 2281. The lower exterior block portion 2281, which may have a rectangular or square shape, may be configured to provide support for a protrusional tab 126 when the straight seam lock block 200 is in use. For example, when the straight seam lock block 200 is positioned over a longitudinal straight seam and force is applied to the straight seam lock block 200, the lower exterior block portion 2281 may prevent the protrusional tab 126 from being bent or deformed. The interior block portion 229 may have a lower interior block portion 2291. The lower interior block portion 2291, which may have a rectangular or square shape, may be configured to be placed above and adjacent to the first sheet metal portion 112. The closing portion 220 may have an overall width $W_{220}$ in the range of 0.4-0.95 inches, and more particularly a width $W_{220}$ of about 0.625 inches. The overall width $W_{220}$ may correspond to a combination of width $W_{228}$, width $W_{229}$, and width $W_{230}$.

The exterior block portion 228 may have a height $H_{228}$ in the range of 0.75-1.50 inches, and more particularly a height $H_{228}$ of about 1.25 inches. The interior block portion 229 may have a height $H_{229}$ in the range of 0.5-1.0 inches, and more particularly a height $H_{229}$ of about 0.875 inches. The center block portion 230 may have a height $H_{230}$ in the range of 0.25-0.75 inches, and more particularly a height $H_{230}$ of about 0.437 inches.

The closing portion 220 may further include a closing channel 232. In some embodiments, the closing channel 232 may extend along the entire length of the closing portion. When viewed from the distal end of the straight seam lock block 200, the closing channel 232 may have a rectangular shape or an inverted curved U-shape. The closing channel 232 may be configured such that the protrusional tab 126 can be fully inserted therein without deformation or bending. The closing channel 232 may have an interior height $H_{232}$ in the range of 0.25-0.75 inches, and more particularly an interior height $H_{232}$ of about 0.437 inches, and an interior width of $W_{232}$ in the range of 0.125-0.250 inches, and more particularly an interior width $W_{232}$ of about 0.187 inches.

Figure 5A:
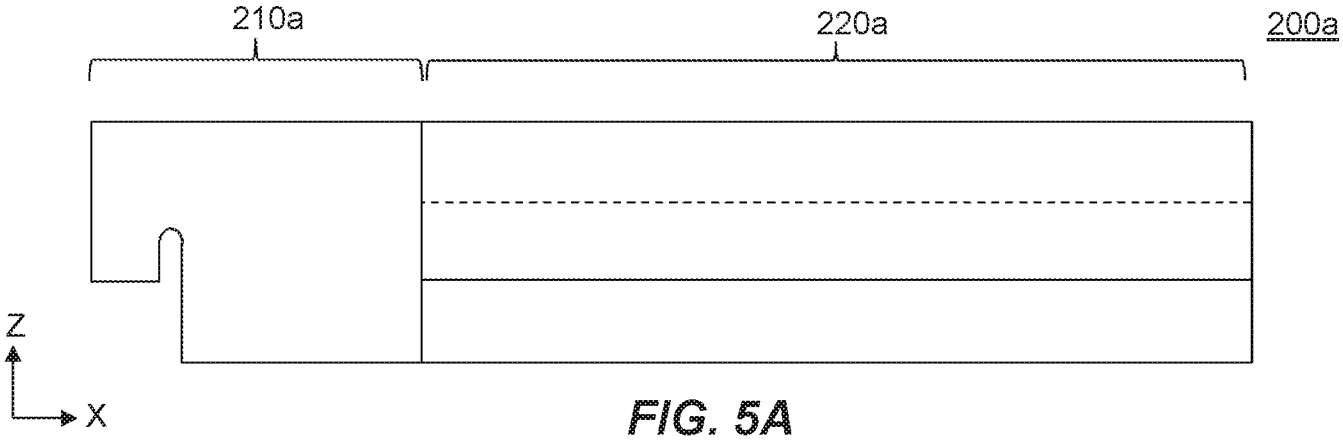
FIGS. 5A and 5B are side views illustrating exemplary straight seam lock blocks, according to certain exemplary embodiments.
Figure 5B:
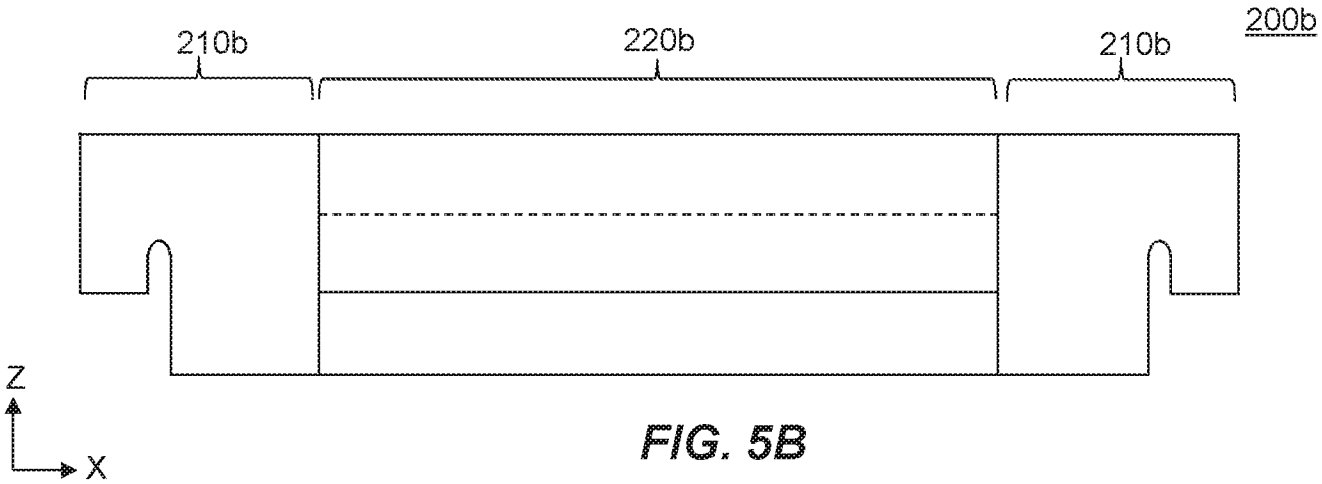

FIGS. 5A and 5B are schematics illustrating straight seam lock blocks 200*a* and 200*b*. As shown in FIG. 5A, straight seam lock block 200*a* may include an opening portion 210*a* and a closing portion 220*a*. Whereas the straight seam lock block 200 is formed such that the opening portion 210 is formed at a first end and the closing portion 220 is formed at a second end, in FIG. 5A, the locations of the opening portion 210*a* and the closing portion 220*a* are inverted such that the opening portion 210*a* is formed at the second end and the closing portion 220*a* is formed at the first end. The shapes and dimensions of the opening portion 210*a* and the closing portion 220*a* may be the same as those of the opening portion 210 and the closing portion 220 of the straight seam lock block 200.

In FIG. 5B, the straight seam lock block 200*b* may include two opening portions 210*b* at opposite ends of the straight seam lock block 200*b* and one closing portion 220*b* between the two opening portions 210*b*. The shapes and dimensions of the opening portions 210*b* and the closing portion 220*b* may be the same as those of the opening portion 210 and the closing portion 220 of the straight seam lock block 200.

Figure 6A:
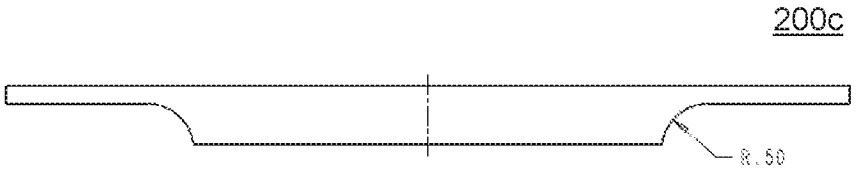
FIGS. 6A, 6B, and 6C are front, side, and end views, respectively, of an exemplary straight seam lock block, according to certain exemplary embodiments.
Figure 6B:
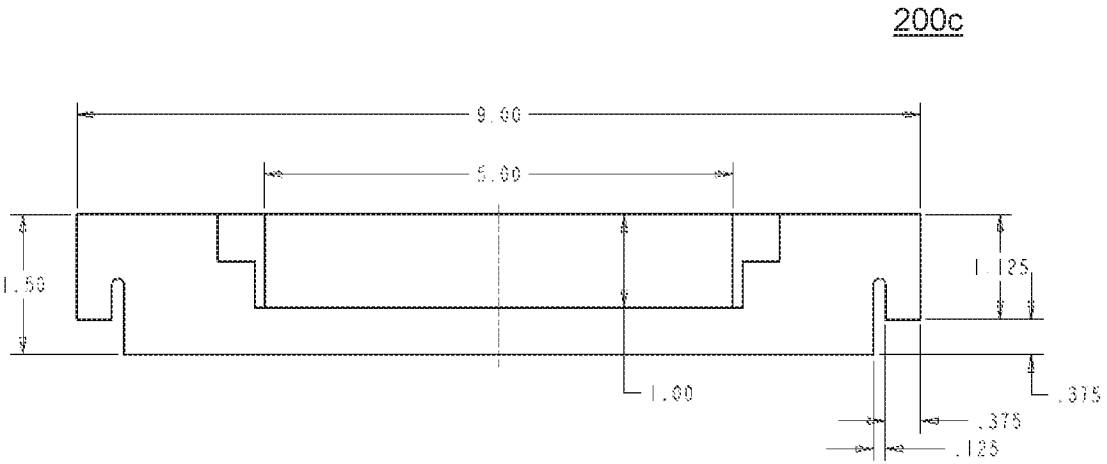
Figure 6C:
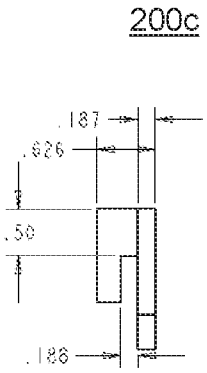

FIGS. 6A, 6B, and 6C are example mechanical drawings of the front, side, and opening portion end views, respectively, of an exemplary straight seam lock block, such as the exemplary straight seam lock block 200*b* of FIG. 5B. In the example of FIGS. 6A-6C, the listed measurements are for illustrative purposes, and the measurements and ranges of measurements discussed above in connection with the embodiments of FIGS. 2A-2B, 3A-3B, and 4A-4B may be applied or adapted to the embodiment illustrated in FIGS. 5B and 6A-6C.

Figure 7:
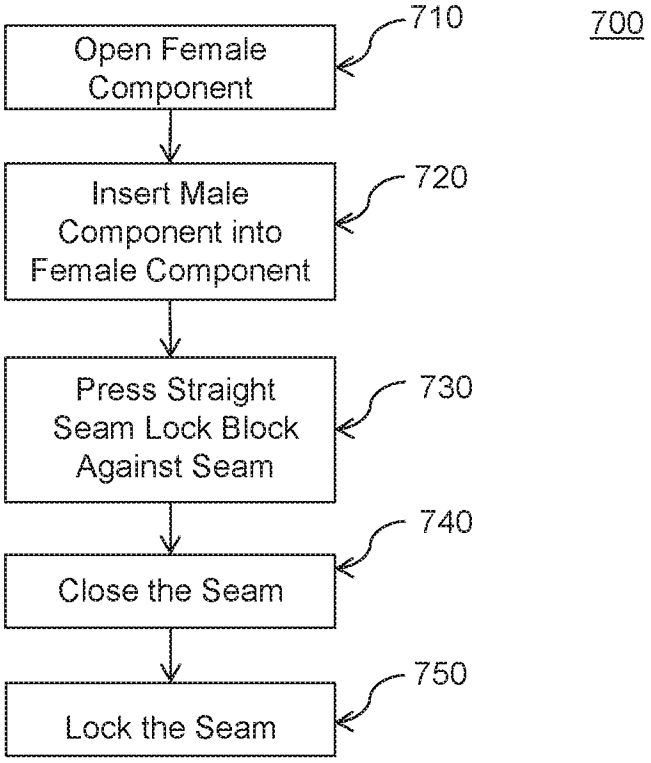
FIG. 7 is a flowchart of a method for using a straight seam lock block, according to certain exemplary embodiments.

FIG. 7 is a flowchart 700 of a method of using a straight seam lock block, according to certain exemplary embodiments. FIGS. 8A-8E are schematics illustrating the steps of FIG. 7.

Figure 8B:
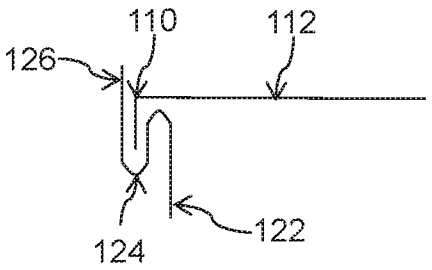
FIGS. 8A-8E are diagrams illustrating the method of FIG. 7, according to certain exemplary embodiments.
Figure 8A:
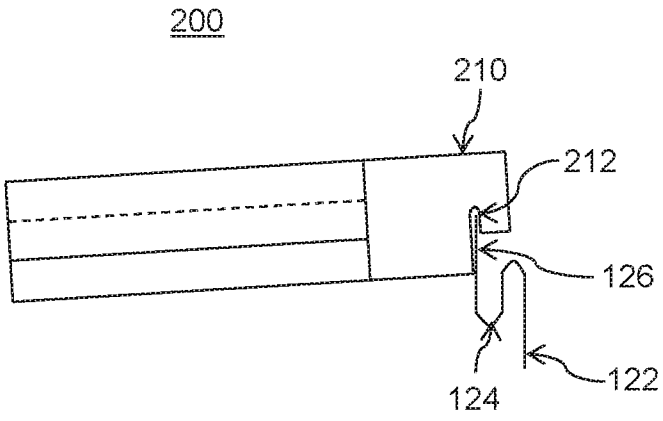

Referring to FIG. 7, the female component 120 of a duct section may be opened using the opening portion 210 of a straight seam lock block 200 (step 710). As illustrated in FIG. 8A, the opening portion 210 may be placed transversely over the female component 120 such that the protrusional tab 126 is located inside the opening channel 212. When the protrusional tab 126 is seated inside the opening channel 212, pressure or force may be applied to the closing portion 220, causing the protrusional tab 126 to bend outwardly and thereby open or widen the receiving channel 124. As illustrated in FIG. 8B, when the receiving channel 124 is open, the male component 110 may be inserted into the receiving channel 124 of the female component 120 (step 720).

Figure 8C:
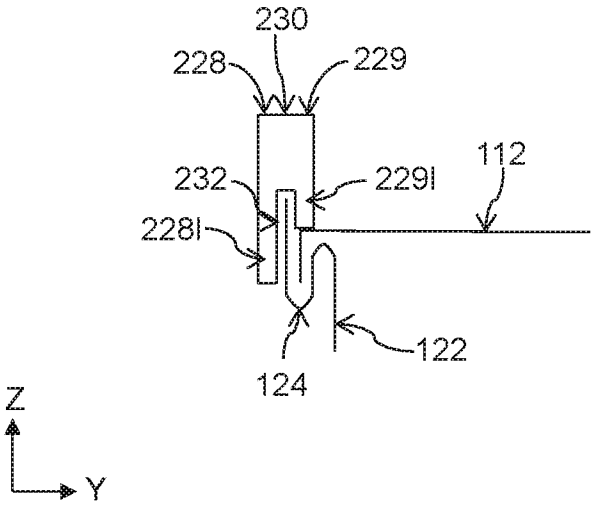
Figure 8D:
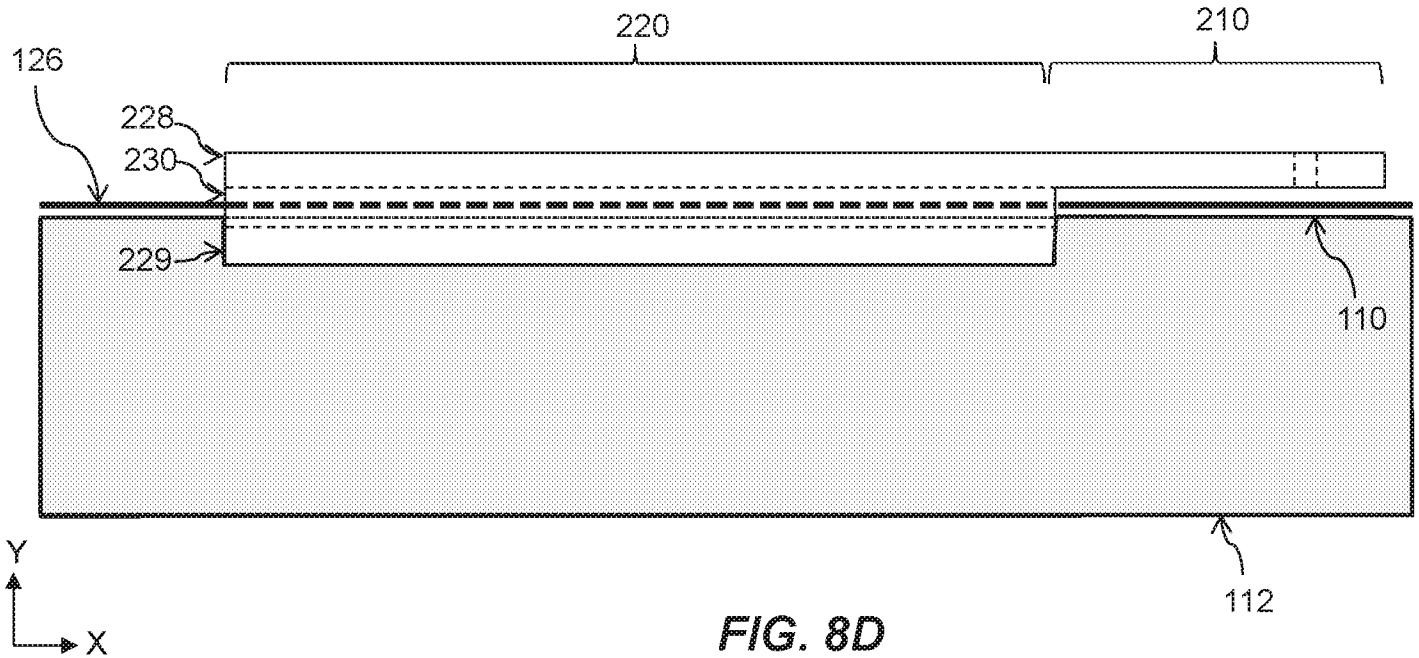
Figure 8E:
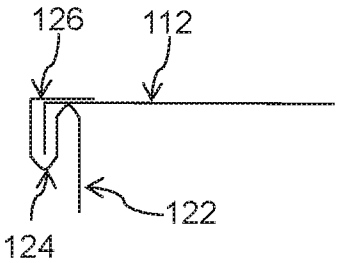

When the male component 110 is fully inserted into the receiving channel 124, the straight seam lock block 200 may be placed over the seam (step 730). As shown in FIG. 8C, the protrusional tab 126 may be located inside the closing channel 232, but may not be in contact with the bottom surface of the center block portion 230. For example, a small gap may exist between the bottom surface of the center block portion 230 and the protrusional tab 126 such that the protrusional tab 126 is not deformed by pressure or force applied to the closing portion 220. As shown in FIGS. 8C and 8D, the interior block portion 229 may be located over the first sheet metal portion 112 corresponding to the male component 110. The interior block portion 229 may be in contact with the first sheet metal portion 112 such that, when pressure or force is applied to the closing portion 220, that pressure or force is transferred to the first sheet metal portion 112. The exterior block portion 228 may be adjacent to the exterior surface of the protrusional tab 126. In some embodiments, an inside surface of the lower exterior block portion 2281 may be in contact with the outside surface of the protrusional tab 126, such that the exterior block portion 228 provides a rigid support for the protrusional tab 126, preventing the protrusional tab 126 from collapsing, bending, or otherwise being deformed.

Next, the seam may be closed by applying force or pressure (step 740). The pressure or force may be applied to the male component 110 and the first sheet metal portion 112 via the straight seam lock block 200. For example, the top or crown of the closing portion 220 of the straight seam lock block 200 may be struck by a hammer or other tool. The force applied to the top or crown of the closing portion 220 may be transferred through the closing portion 220 to the first sheet metal portion 112 via the interior block portion 229. The applied force may cause the male component 110 to be inserted more fully inside the female component 120, thereby closing the seam.

After the seam is closed, the straight seam lock block 200 is removed and the seam is locked (step 750). For example, as shown in FIG. 8D, the protrusional tab 126 may be bent inwardly at approximately 90° so that it lies adjacent to and against the outer surface of the first sheet metal section 112. When the protrusional tab 126 is bent, the Pittsburgh seam 100 may be considered closed and locked.

Figure 9A:
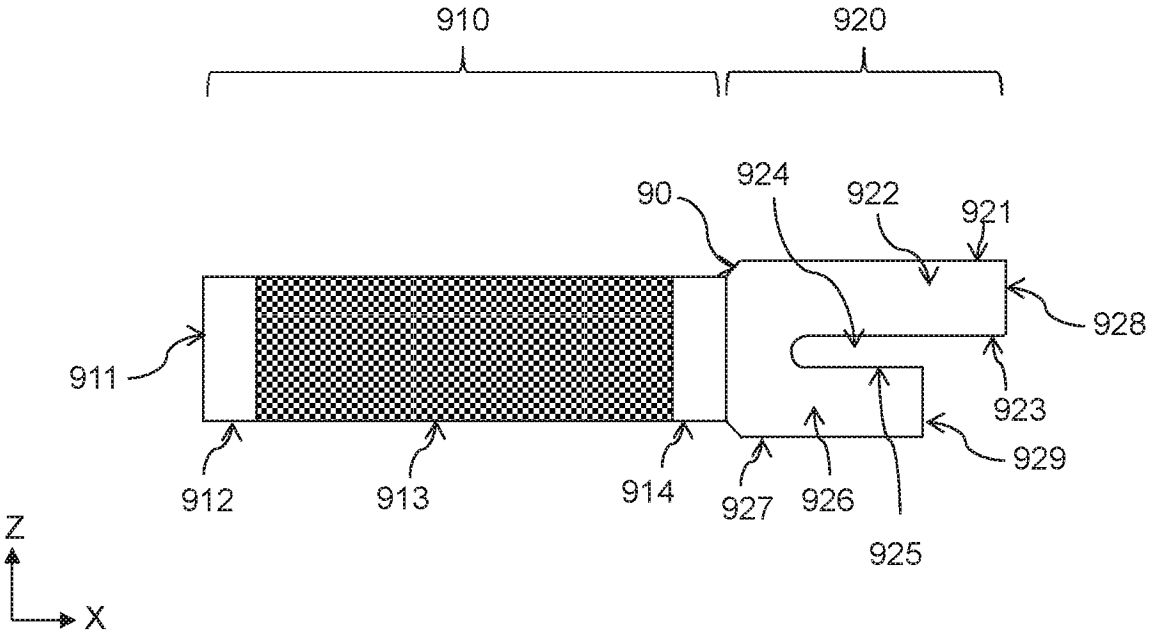
FIGS. 9A-9B are side views illustrating a punch seam lock block, according to certain exemplary embodiments.
Figure 9B:
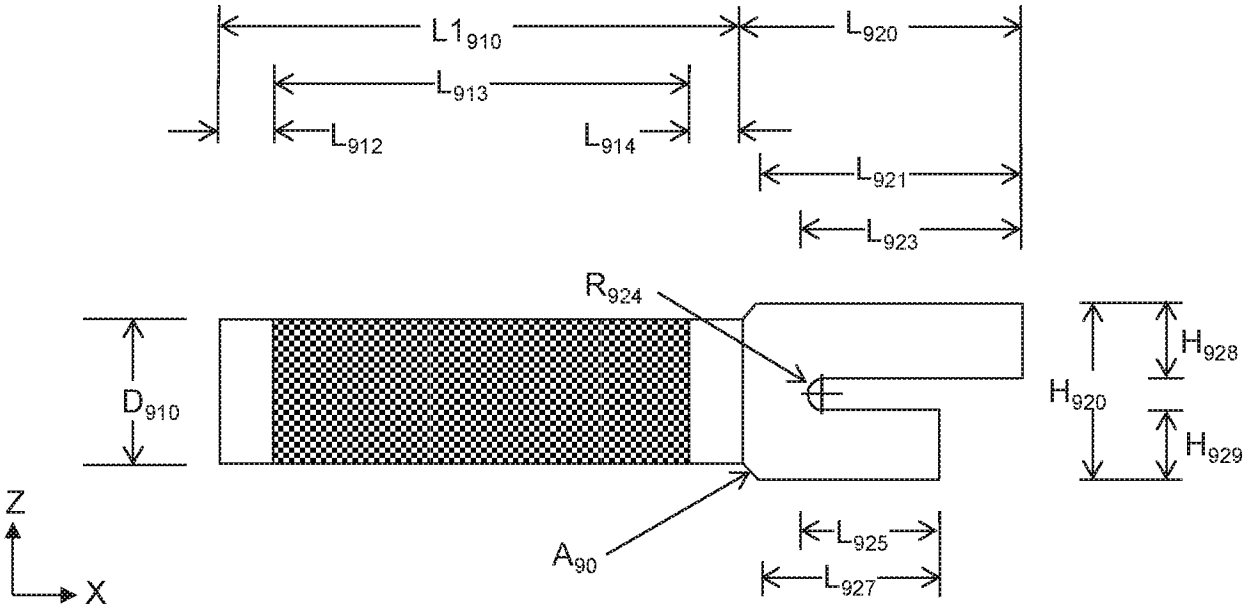
Figure 10B:
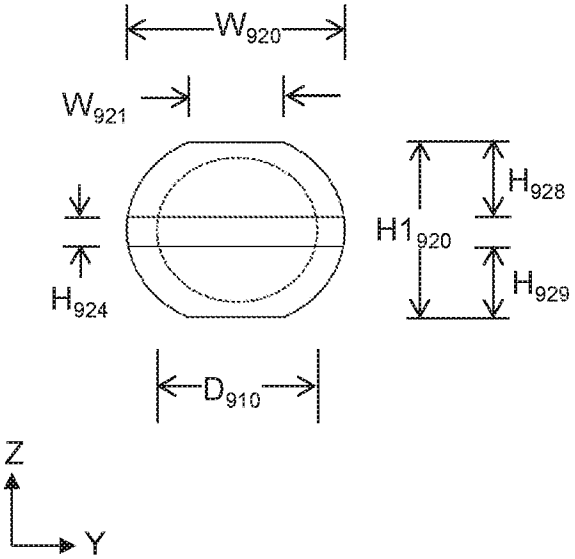
FIGS. 10A-10B are end views illustrating a punch seam lock block, according to certain exemplary embodiments.
Figure 10A:
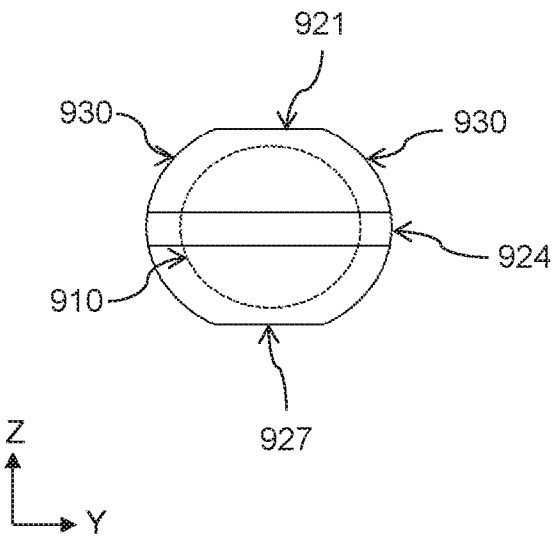

FIGS. 9A and 9B are schematics corresponding to a side view of an example punch seam lock block 900, and FIGS. 10A and 10B are schematics corresponding to an end view of the example punch seam lock block 900. The punch seam lock block 900 may be a handheld tool configured for mechanically closing Pittsburgh seams. The punch seam lock block 900 may have a shape that is elongated. The punch seam lock block 900 may be a single unitary tool formed of a metal, such as, for example, steel. The punch seam lock block 900 may be formed from a single, solid block of such a metal by, for example, milling or other metal-working processes.

As shown in FIGS. 9A and 9B, the punch seam lock block 900 may have a handle portion 910 and a closing portion 920. The handle portion 910 may have an elongated tubular shape, and may have a diameter $D_{910}$ in the range of 0.5-1.0 inches, and more particularly a diameter $D_{910}$ of about 0.75 inches. The handle portion 910 may have a length $L_{910}$ in the range of 2.0-4.0 inches, and more particularly a length $L_{910}$ of about 2.187 inches.

The handle portion 910 may include a crown surface 911, a crown portion 912, a grip portion 913, and a transition portion 914. The crown surface 911 may be located at a distal end of the handle portion 910. In the embodiment illustrated in FIGS. 9A-9B, the crown surface 911 is shown as having a flat, planar surface that is substantially perpendicular to the longitudinal axis of the handle portion 910. In other embodiments, the crown surface 911 may have a convex or concave shape. The crown surface 911 may be round and may have a diameter that is the same as the diameter $D_{910}$. Although not illustrated, the perimeter region near the circumferential edge of the crown surface 911 may be chamfered. The chamfered perimeter region may be the outermost band of the crown surface 911 along its perimeter edge. For example, when the crown surface 911 has a diameter $D_{910}$ of 0.75 inches (radius of 0.375 inches), the chamfered perimeter region may extend along the perimeter edge in the range from 0.32 to 0.375 inches from a center point of the crown surface 911, or more particularly, from about 0.345 inches from the center point of the crown surface 911 to 0.375 inches (i.e., the outside edge of the crown surface 911).

The crown portion 912 may be adjacent to the crown surface 911 along a perimeter of the crown surface 911. The grip portion 913 may be located between the crown portion 912 and the transition portion 914. In some embodiments, the crown portion 912 and the transition portion 914 may have smooth surfaces, and the grip portion 912 may have a knurled surface. The knurled surface of the grip portion 912 may allow a user to maintain a firm handhold on the punch seam lock block 900. The crown portion 912 may have a length $L_{912}$ in the range of 0.2-1.0 inches, and more particularly a length $L_{912}$ of about 0.25 inches. The grip portion 913 may have a length $L_{913}$ in the range of 1.25-2.5 inches, and more particularly a length $L_{913}$ of about 1.687 inches. The transition portion 914 may have a length $L_{914}$ in the range of 0.2-1.0 inches, and more particularly a length $L_{914}$ of about 0.25 inches The closing portion 920 may include an angled surface 90, an exterior block portion 922, an interior block portion 923, and a receiving channel 924. The closing portion 920 may have a length $L_{920}$ in the range of 1-3 inches, and more particularly a length $L_{920}$ of about 1.687 inches. Referring to FIGS. 10A and 10B, the closing portion 920 may have a width $W_{920}$ in the range of 1-3 inches, and more particularly a width $W_{920}$ of about 1.125 inches. Each of the width $W_{920}$ and the height $H_{920}$ of the closing portion 920 may be greater than the diameter $D_{910}$ of the handle portion 910.

The angled surface 90 may provide a transition from the diameter $D_{910}$ of the handle portion 910 to the width $W_{920}$ and the height $H_{920}$ of the closing portion 920. The angled surface 90 may have an angle $A_{90}$ relative to the longitudinal axis of the punch seam lock block 900. The angle $A_{90}$ may be in the range of 25-60 degrees, and more particularly the angle $A_{90}$ may be about 45 degrees.

The exterior block portion 922 may have an outside surface 921 having a length $L_{921}$ in the range of 1-2 inches, and more particularly a length $L_{921}$ of about 1.5 inches, an inside surface 923 having a length $L_{923}$ in the range of 0.75-1.5 inches, and more particularly a length $L_{923}$ of about 1.125 inches, and an end surface 928 having a height $H_{928}$ in the range of 0.2-0.5 inches, and more particularly a length $H_{928}$ of about 0.34 inches. The outside surface 921 may be a flat milled surface having a width $W_{921}$ in the range of 0.25 to 0.75 inches, and more particular a width $W_{921}$ of about 0.484 inches. The outside surface 921 and the inside surface 923 may be substantially parallel to one another and to the longitudinal axis of the punch seam lock block 900, and the end surface 928 may be substantially perpendicular to the outside surface 921 and the inside surface 923.

The interior block portion 926 may have an outside surface 927 having a length $L_{927}$ in the range of 0.5-1.5 inches, and more particularly a length $L_{927}$ of about 1.0 inches, an inside surface 925 having a length $L_{925}$ in the range of 0.3-1.0 inches, and more particularly a length $L_{925}$ of about 0.625 inches, and an end surface having a height $H_{929}$ in the range of 0.2-0.5 inches, and more particularly a height $H_{929}$ of about 0.34 inches. The outside surface 927 may be a flat milled surface having a width that is the same as the width $W_{921}$ of outside surface 921. The inside surface 925 and the outside surface 927 may be substantially parallel to one another and to the longitudinal axis of the punch seam lock block 900, and the end surface 929 may be substantially perpendicular to the inside surface 925 and the outside surface 927.

Side surfaces 930 of the exterior block portion 922 and the interior block portion may extend continuously from the outside surface 921 of the exterior block portion 922 to the outside surface 927 of the interior block portion 922. The side surface 930 may be rounded and have a smooth surface.

The receiving channel 924 may be formed between portions of the exterior block portion 922 and the interior block portion 924. For example, the receiving channel may extend from the inside surface 923 to the inside surface 925. The receiving channel 924 may have a U-shape. The receiving channel 924 may be configured such that the protrusional tab 126 can be fully inserted therein without deformation or bending. The receiving channel 924 may have a depth that is the same as the length of the inside surface 925 of the interior block portion 926 (i.e., a length $L_{925}$ in the range of 0.3-1.0 inches, and more particularly a length $L_{925}$ of about 0.625 inches). The receiving channel 924 may have an interior height $H_{924}$ in the range of 0.1-0.3 inches, and more particularly a height $H_{924}$ of about 0.187 inches. The receiving channel 924 may have an interior width that is the same as the width of the closing portion 920 (i.e., width $W_{920}$ in the range of 1-3 inches, and more particularly a width $W_{920}$ of about 1.125 inches). In some embodiments, the receiving channel 924 may have an interior round surface. The interior round surface may be formed from portions of the interior surface 923 and interior surface 925. The interior round surface may have a radius $R_{924}$ in the range of 0.05-0.2 inches, and more particularly a radius $R_{924}$ of about 0.0935 inches. Although not illustrated, the receiving channel 924 may have other shapes, such as, for example, a polygonal shape (i.e., triangular, square, pentagonal, etc.).

Figure 11:
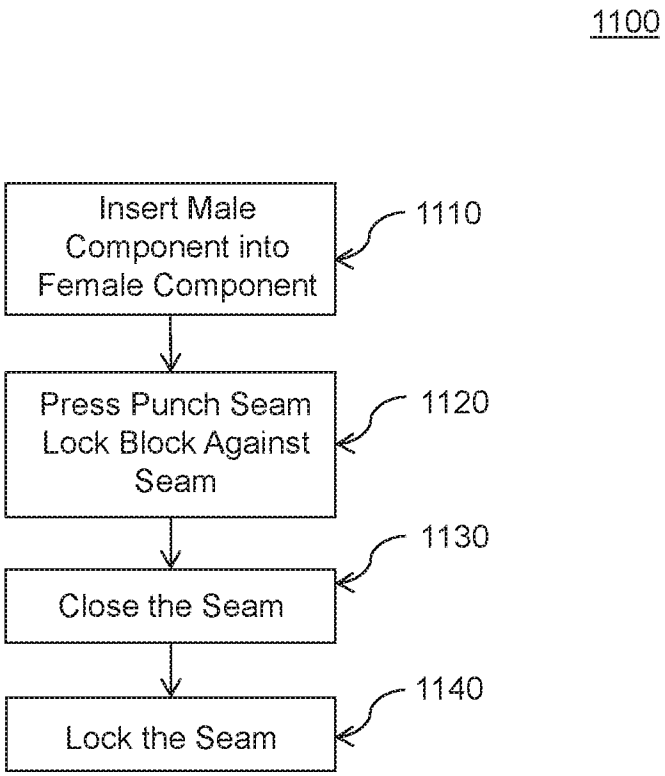
FIG. 11 is a flowchart for a method of using a punch seam lock block, according to certain exemplary embodiments.
Figure 12:
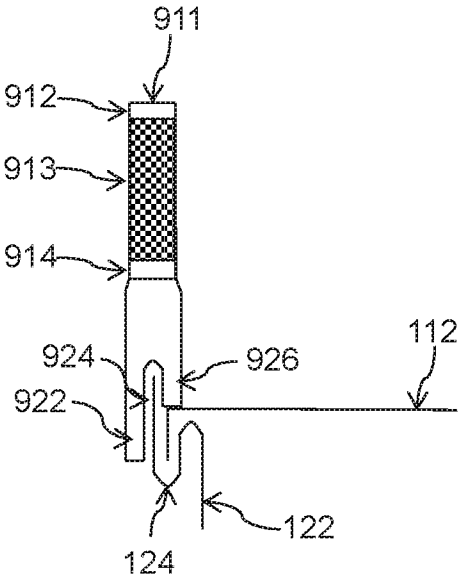
FIG. 12 is a diagram illustrating the method of FIG. 11, according to certain exemplary embodiments.

FIG. 11 is a flowchart 1100 of a method of using a straight seam lock block, according to certain exemplary embodiments. FIG. 12 is a schematic illustrating the method discussed in FIG. 11. Prior to the method of FIG. 11, the female component 120 of a duct section may be opened. For example, as discussed above in connection with step 710 of FIG. 7, the female component 120 may be opened using the opening portion 210 of a straight seam lock block 200. Then, as illustrated in FIG. 8B, when the receiving channel 124 is open, the male component 110 may be inserted into the receiving channel 124 of the female component 120 (step 1110).

When the male component 110 is fully inserted into the receiving channel 124, the punch seam lock block 900 may be placed over the seam (step 1120). As shown in FIG. 12, the protrusional tab 126 may rest inside the receiving channel 924 between the inside surface 923 and the inside surface 935, but may not be in contact with portions of the interior curved surface of the receiving channel 924. For example, a small gap may exist between the interior curved surface of the receiving channel 924 and the protrusional tab 126 such that the protrusional tab 126 is not deformed by pressure or force applied to the punch seam lock block 900. The interior block portion 922 may be located over the first sheet metal portion 112 corresponding to the male component 110. Although not illustrated in FIG. 12, the end surface 929 of the interior block portion 922 may be in contact with the first sheet metal portion 112 such that, when pressure or force is applied to the punch seam lock block 900, that pressure or force is transferred to the first sheet metal portion 112. The interior surface 923 of the exterior block portion 922 may be adjacent to an outside surface of the protrusional tab 126. In some embodiments, the inside surface 923 of the exterior block portion 922 may be in contact with the outside surface of the protrusional tab 126, such that the exterior block portion 926 provides a rigid support for the protrusional tab 126, preventing the protrusional tab 126 from collapsing, bending, or otherwise being deformed.

Next, the seam may be closed by applying force or pressure (step 1130). The pressure or force may be applied to the male component 110 and the first sheet metal portion 112 via the punch seam lock block 900. For example, as a user holds the punch seam lock block 900 by the handle portion 910, the crown surface 911 of the handle portion 910 may be struck by a hammer or other tool. The force applied to the crown surface 911 may be transferred through the handle portion 910 and the closing portion 920 along the longitudinal direction to the first sheet metal portion 112 via the interior block portion 924 of the punch seam lock block 900. The applied force may cause the male component 110 to be inserted more fully inside the female component 120, thereby closing the seam.

After the seam is closed, the punch seam lock block 900 is removed and the seam is locked (step 1140). For example, as discussed above and shown in FIG. 8E, the protrusional tab 126 may be bent inwardly at approximately 90° so that it lies adjacent to and against the outer surface of the first sheet metal section 112. When the protrusional tab 126 is bent, the Pittsburgh seam 100 may be considered closed and locked.

The disclosed embodiments may provide for manual opening of the female portion to allow for easier access prior to assembly, and prevent or minimize disfiguration caused by hammering the male and female pieces together. The disclosed embodiments may make the assembly less time-consuming, and thereby increase productivity, improve quality, and reduce costs.

The present disclosure is not to be limited in terms of the particular embodiments described in this application, which are intended as illustrations of various aspects. Many modifications and variations can be made without departing from its spirit and scope, as will be apparent. Functionally equivalent methods and apparatuses within the scope of the disclosure, in addition to those enumerated herein, will be apparent from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

The foregoing description, along with its associated embodiments, has been presented for purposes of illustration only. It is not exhaustive and does not limit the invention to the precise form disclosed. Those skilled in the art will appreciate from the foregoing description that modifications and variations are possible in light of the above teachings or may be acquired from practicing the disclosed embodiments. For example, the steps described need not be performed in the same sequence discussed or with the same degree of separation. Likewise, various steps may be omitted, repeated, or combined, as necessary, to achieve the same or similar objectives. Accordingly, the invention is not limited to the above-described embodiments, but instead is defined by the appended claims in light of their full scope of equivalents.

What is claimed is:

1. A handheld tool for opening and closing seams of duct assemblies, comprising:

an opening portion including a latching portion and an opening channel recessed into the latching portion, the opening channel being configured to receive and retain a protrusional tab of a first sheet metal portion having a female component of a longitudinal straight seam; and a closing portion including an interior block portion, an exterior block portion, and a closing channel formed between the interior block portion and the exterior block portion, the interior block portion being configured to contact a second sheet metal portion having a male component of the longitudinal straight seam and the closing channel being configured to extend over the protrusional tab when the interior block portion is in contact with the second sheet metal portion, wherein the opening portion is at a first end of the handheld tool and the closing portion is at a second end of the handheld tool, the second end being opposite to the first end, and wherein the opening channel is offset from the closing channel by 90 degrees.

2. The handheld tool of claim 1, wherein the opening portion has a top surface having a length of about 2 inches, and a bottom surface having a length of about 1.5 inches, and wherein the top surface and the bottom surface are substantially parallel to one another.

3. The handheld tool of claim 2, wherein the opening portion has an end surface having a length of about 0.75 inches, and wherein the end surface is substantially perpendicular to the top surface and the bottom surface.

4. The handheld tool of claim 1, wherein the closing portion has a length of about 5 inches, a height of about 1.25 inches, and a width of about 0.625 inches.

5. The handheld tool of claim 4, wherein the interior block portion has a length of about 5 inches, a height of about 0.874 inches, and a width of about 0.250 inches.

6. The handheld tool of claim 4, wherein the exterior block portion has a length of about 5 inches, a height of about 1.25 inches, and a width of about 0.187 inches.

7. The handheld tool of claim 4, wherein the closing channel has an interior height of about 0.437 inches, and an interior width of about 0.187 inches.

8. The handheld tool of claim 1, wherein the closing channel extends continuously along the closing portion.

9. A handheld tool for opening and closing seams of duct assemblies, comprising:

an opening portion including a latching portion and an opening channel recessed into the latching portion, the opening channel being configured to receive and retain a protrusional tab of a first sheet metal portion having a female component of a longitudinal straight seam; and a closing portion including an interior block portion, an exterior block portion, and a closing channel formed between the interior block portion and the exterior block portion, the interior block portion being configured to contact a second sheet metal portion having a male component of the longitudinal straight seam and the closing channel being configured to extend over the protrusional tab when the interior block portion is in contact with the second sheet metal portion, wherein the opening portion is at a first end of the handheld tool and the closing portion is at a second end of the handheld tool, the second end being opposite to the first end, and wherein the opening channel extends in a first direction and the closing channel extends in a second direction perpendicular to the first direction.

10. The handheld tool of claim 9, wherein the opening portion has a top surface having a length of about 2 inches, and a bottom surface having a length of about 1.5 inches, and wherein the top surface and the bottom surface are substantially parallel to one another.

11. The handheld tool of claim 10, wherein the opening portion has an end surface having a length of about 0.75 inches, and wherein the end surface is substantially perpendicular to the top surface and the bottom surface.

12. The handheld tool of claim 9, wherein the closing portion has a length of about 5 inches, a height of about 1.25 inches, and a width of about 0.625 inches.

13. The handheld tool of claim 12, wherein the interior block portion has a length of about 5 inches, a height of about 0.874 inches, and a width of about 0.250 inches.

14. The handheld tool of claim 12, wherein the exterior block portion has a length of about 5 inches, a height of about 1.25 inches, and a width of about 0.187 inches.

15. The handheld tool of claim 12, wherein the closing channel has an interior height of about 0.437 inches, and an interior width of about 0.187 inches.

16. The handheld tool of claim 9, wherein the closing channel extends continuously along the closing portion.

* * * * *